US007381108B1

(12) United States Patent
Salmon

(10) Patent No.: US 7,381,108 B1
(45) Date of Patent: Jun. 3, 2008

(54) TROLLING MOTOR SYSTEM WITH AUTO RETRACT

(75) Inventor: Paul D. Salmon, North Mankato, MN (US)

(73) Assignee: Johnson Outdoors, Inc., Mankato, MN (US)

( * ) Notice: Subject to any disclaimer, the term of this patent is extended or adjusted under 35 U.S.C. 154(b) by 0 days.

(21) Appl. No.: 11/656,859

(22) Filed: Jan. 23, 2007

(51) Int. Cl.
*B60L 11/00* (2006.01)
*B63B 1/22* (2006.01)

(52) U.S. Cl. ..... 440/6; 114/285

(58) Field of Classification Search ..... 440/6
See application file for complete search history.

(56) References Cited

U.S. PATENT DOCUMENTS 3,881,443 A * 5/1975 Hamp ..... 440/1
4,261,278 A 4/1981 Gaudin
4,401,888 A 8/1983 West et al.
4,420,741 A 12/1983 West
4,424,041 A * 1/1984 Sietmann et al. ..... 440/5
4,644,893 A 2/1987 Zepp
4,742,794 A 5/1988 Hagstrom
4,749,926 A 6/1988 Ontolchik
4,832,642 A 5/1989 Thompson
4,854,259 A 8/1989 Cluett
5,017,165 A 5/1991 Havins
5,058,520 A 10/1991 Fahrney
5,142,473 A 8/1992 Davis
5,263,432 A 11/1993 Davis
5,385,110 A 1/1995 Bennett et al.
5,474,012 A 12/1995 Yamada et al.
5,704,308 A * 1/1998 Anderson ..... 114/285
5,832,863 A 11/1998 Sherlock
5,842,895 A 12/1998 DeVito, Jr.
5,878,686 A 3/1999 Anderson
5,881,666 A 3/1999 Crews, Jr.
6,085,684 A 7/2000 Cotton
6,174,210 B1 1/2001 Spade et al.
6,280,269 B1 8/2001 Gaynor
6,354,237 B1 3/2002 Gaynor et al.
6,520,813 B1 2/2003 DeVito, Jr.
6,583,728 B1 6/2003 Staerzl
6,823,812 B2 11/2004 von Wolske
6,863,581 B2 3/2005 Anderson

* cited by examiner

*Primary Examiner*—Jesús D Sotelo
(74) *Attorney, Agent, or Firm*—Kinney & Lange, P.A.

(57) ABSTRACT

A boat control system includes trim tabs mounted on the lower transom of a boat, with an electric trolling motor attached to each tab. The control system controls positioning of the trim tabs within a trim range and within a troll range. If a main engine ignition switch changes from off to on while the trim tabs are within the troll range, the control system automatically moves trim tabs positions out of the troll range, and disables the trolling motors.

12 Claims, 7 Drawing Sheets

TROLLING MOTOR SYSTEM WITH AUTO RETRACT

REFERENCE TO COPENDING APPLICATIONS

Reference is made to application Ser. No. 11/656,781 entitled "Boat Control System With Return To Center Steering Command" and application Ser. No. 11/656,860 entitled "Trim Tab Control", which are filed on even date and are assigned to the same assignee as this application.

BACKGROUND OF THE INVENTION

The present invention relates to boat control systems. In particular, the invention relates to control of trim tabs and trolling motors mounted to the transom of a boat.

Trim tabs are plates that are mounted on the lower transom of a boat. Typically, at least one trim tab is pivotally mounted on the left or port side and at least one trim tab is pivotally mounted on the right or starboard side of the transom. In other cases, a single center-mounted trim tab can be used. The trim tabs are raised and lowered by a drive mechanism. Early trim tab systems used mechanical jack-screws to raise and lower the trim tabs. Currently available systems use either hydraulic or electromechanical actuators to raise and lower the trim tabs.

Trim tabs are used to provide additional boat control for reasons such as uneven load distribution in the boat, controlling bow attitude in various water conditions, and trimming the boat out of the water faster in conditions such as shallow water operations. Depending on the type of boat and the number and position of occupants, the attitude (or side-to-side angle along the keel) can tilt left or right. Trim tabs can improve boat performance by leveling the boat. Trim tabs also can be used to increase top end speed, to improve "hole-shot", and to provide a dryer ride by keeping the nose down and the boat up on plane.

Fishing boats are often equipped with a trolling motor that provides a relatively small amount of thrust to slowly and quietly propel the boat while the operator is fishing. The electric trolling motor is powered by a battery or batteries, and is mounted to either the bow or the stern of the boat. The trolling motor is raised out of the water when not in use and when the boat is being driven at high speed by the main engine.

Electric trolling motors have also been mounted on trim tabs, as shown in U.S. Pat. Nos. 5,704,308; 5,878,686; and 6,863,581 by Anderson and in U.S. Pat. Nos. 5,842,895, and 6,520,813 by DeVito, Jr. When the trim tabs are performing a trimming function, the trolling motors are elevated so they are out of the water. When trolling is required, the position of the trim tabs is adjusted so that the trolling motor is below the surface of the water and can provide thrust to move the boat. Steering with the trim tab mounted trolling motors is accomplished by adjusting the relative speeds and propeller directions of the motors mounted on the left and right trim tabs.

This type of propulsion can offer a number of benefits to anglers. First, trim tab mounted trolling motors provide an alternative to either a bow mounted or a transom mounted trolling motor. The trim tab mounted trolling motors keep the lines of the boat cleaner, and provide less obstruction to the angler while fishing from various locations within the boat.

Second, the trolling motors allow the boat to run in very shallow water. The trim tabs can position the electric trolling motors just below the surface of the water.

Third, a pair of electric trolling motors mounted on trim tabs at the back of the boat can deliver twice the thrust of a single trolling motor with a traditional transom mount, or a single trolling motor with a bow mount.

BRIEF SUMMARY OF THE INVENTION

A control system provides an auto retract function when a trolling motor is in a troll range. The state of the main engine of the boat is monitored. If the main engine changes from an off to an on state, the control system automatically causes the trolling motor to move to a position out of the troll range.

In one embodiment the trolling motor is mounted on a trim tab to provide controllable boat trimming and operation at low speeds for trolling using the trolling motor. The control system controls positioning of the trim tab and operation of the electric motor. The trim tab is selectively positioned within a trim range to provide trimming of a boat. When trolling operation is desired, the trim tab is moved downward into a lower troll range, where the trolling motor can be operated to provide thrust to move the boat. When the control system detects that the main engine has turned on, it automatically causes the trim tab to move upward out of the troll range.

DETAILED DESCRIPTION

Figure 1:
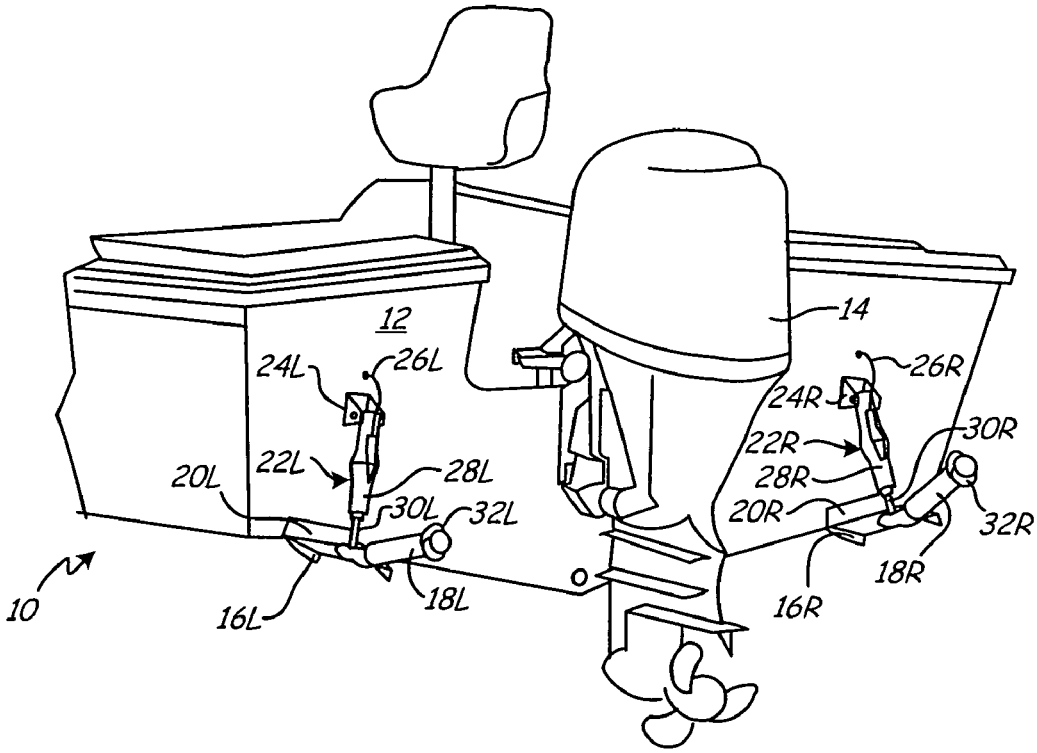
FIG. 1 is a perspective view of a stern of a boat with electric trolling motors mounted on trim tabs.

FIG. 1 shows the stern of boat 10. Mounted on transom 12 is outboard motor 14 and trim tabs 16L and 16R. Left or port trolling motor 18L is carried by left trim tab 16L, and right or starboard trolling motor 18R is carried by right trim tab 16R. Hinges 20L and 20R pivotally connect trim tab 16L and 16R, respectively, to transom 12. Linear actuators 22L and 22R are connected between brackets 24L, 24R on transom 12 and trim tabs 16L and 16R, respectively. The angle of each trim tab 16L, 16R is determined by the amount of extension of actuators 22L and 22R, respectively. Actuators 22L and 22R are, in one embodiment, electromechanical actuators that receive electrical power and provide feedback signals through cables 26L, 26R. Actuator 22L includes actuator housing 28L and actuator rod 30L; and actuator 22R includes actuator housing 28R and actuator rod 30R.

Trim tabs 16L and 16R operate in a trim range from about 0° (horizontal) to about 20° below horizontal. Trim tabs 16L and 16R can be individually adjusted within the trim range, or can be adjusted together by equal amounts.

When trolling is desired, trim tabs 16L and 16R are moved to a troll range, which is below the trim range. The troll range may be, for example, between about 20° to 30° below horizontal. Trim tabs 16L and 16R are moved together to the same angle within the troll range, so that both trolling motors 18L and 18R are at the same elevation. During trolling, trolling motors 18L and 18R are electrically driven so that their propellers 32L and 32R rotate. The relative speed and direction of rotation of propellers 32L and 32R can be controlled to achieve movement of boat 10 forward or in reverse and to achieve steering to the left or right.

Figure 2A:
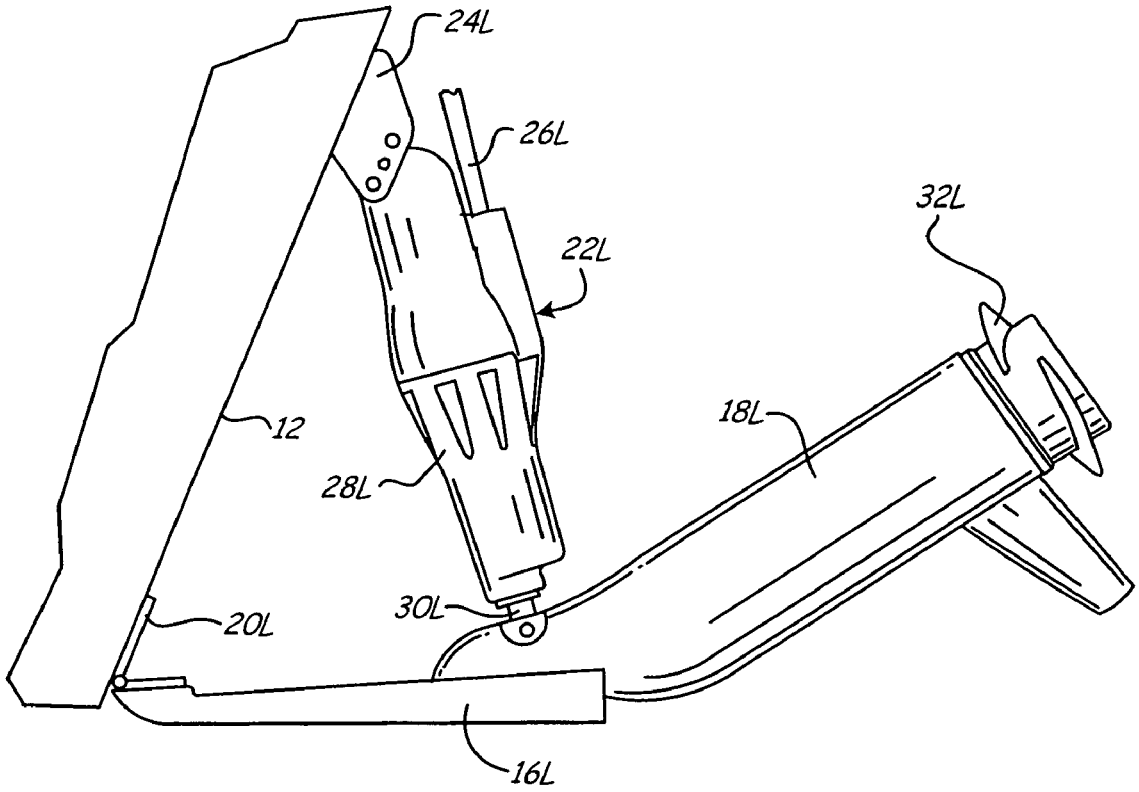
FIG. 2A is a side view of a trim tab and an electric trolling motor in a fully retracted up position.
Figure 2B:
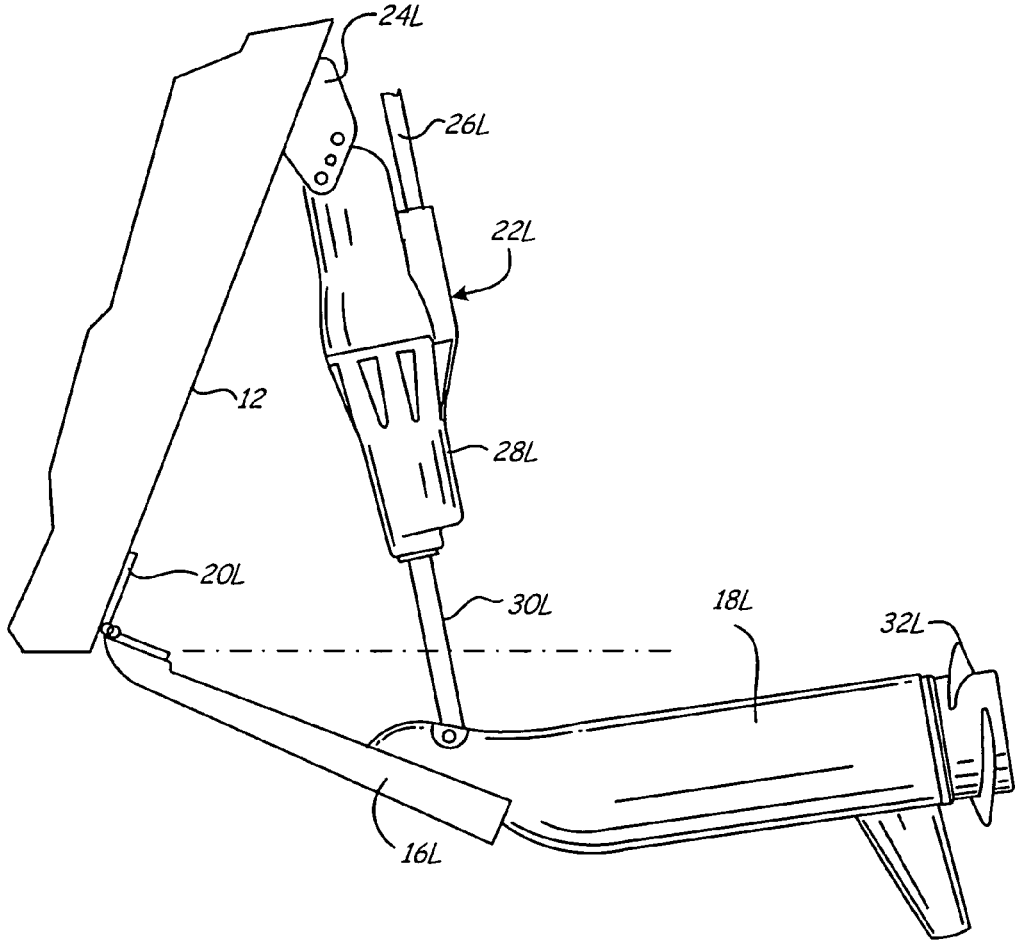
FIG. 2B is a side view of a trim tab and an electric trolling motor with the trim tab positioned at a bottom end of a trim range.
Figure 2C:
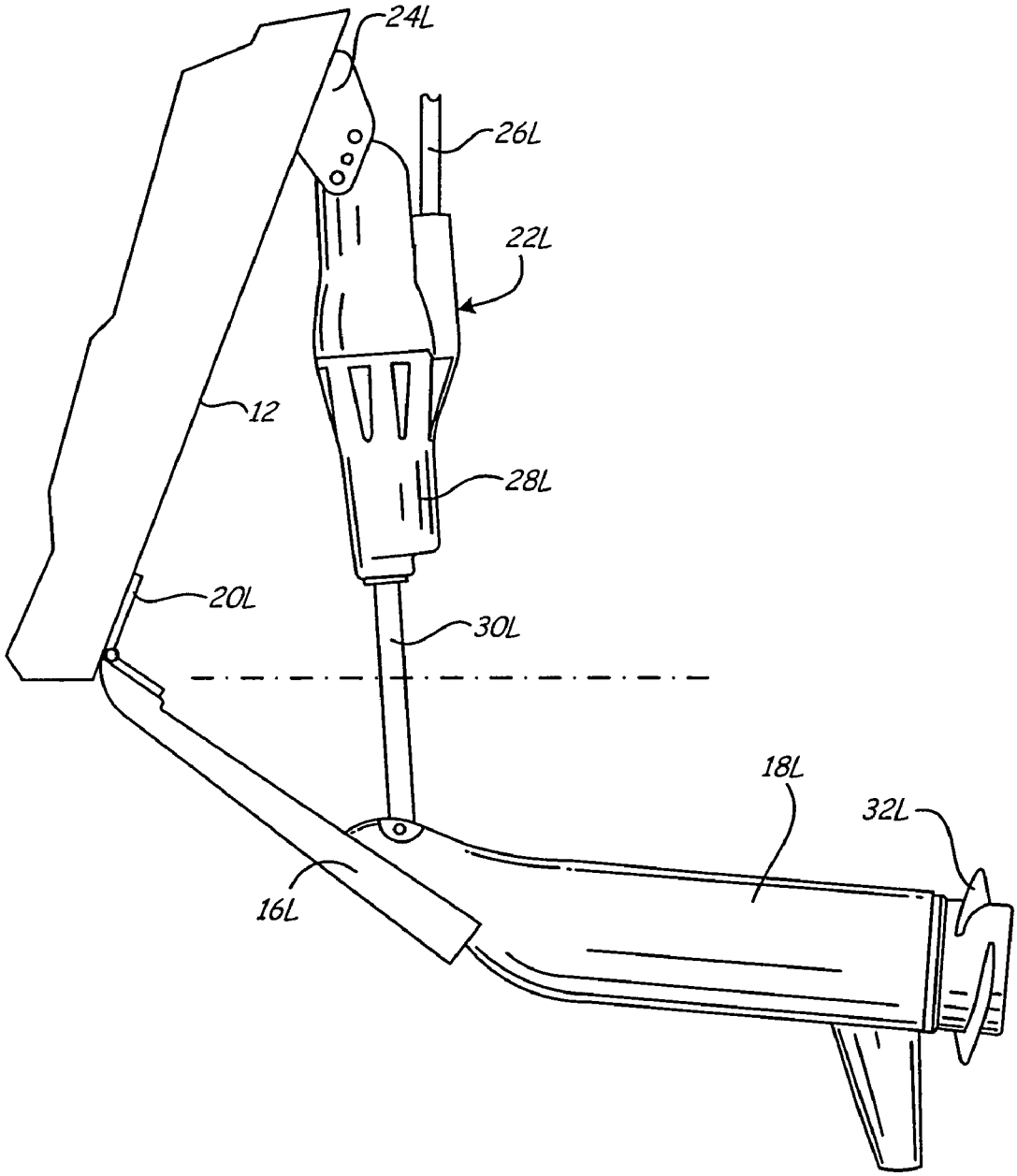
FIG. 2C is a side view of a trim tab and an electric trolling motor with the trim tab and trolling motor positioned at a bottom end of a troll range.

FIGS. 2A-2C illustrate the range of movement of the trim tabs 16L and 16R. FIG. 2A shows the uppermost or fully retracted position of trim tab 16L. At this position, trim tab 16L is approximately horizontal, so that it has no trimming effect on boat 10. Trolling motor 18L is mounted with respect to trim tab 16L at an upward inclination, so that trolling motor 18L (and in particular propeller 32L) will be out of the water.

FIG. 2B shows trim tab 16L positioned at the bottom of the trim range. In this position, trim tab 16L is inclined downward from home position shown in FIG. 2A by approximately 20°. Each trim tab 16L and 16R is individually or jointly adjustable to any position between the fully retracted position shown in FIG. 2A and the bottom of trim range position shown in FIG. 2B.

FIG. 2C shows trim tab 16L and motor 18L at the bottom of the troll range. As shown in FIG. 2C, trim tab 16L is inclined at about 30° downward with respect to the fully retracted position shown in FIG. 2A, and thus is inclined downward by an additional 10° with respect to the bottom of trim range depicted in FIG. 2B. When tabs 16L and 16R are in the troll range, trolling motors 18L and 18R are below the water surface, so that rotation of propellers 32L and 32R provides thrust to move boat 10 in a forward direction, a reverse direction, in a turn to the left, or in a turn to the right.

Steering is achieved using motors 18L and 18R by changing the thrust levels of motors 18L and 18R with respect to one another. In extreme steering conditions, propellers 32L and 32R may be rotating in opposite directions in order to provide sharper turning.

Figure 3:
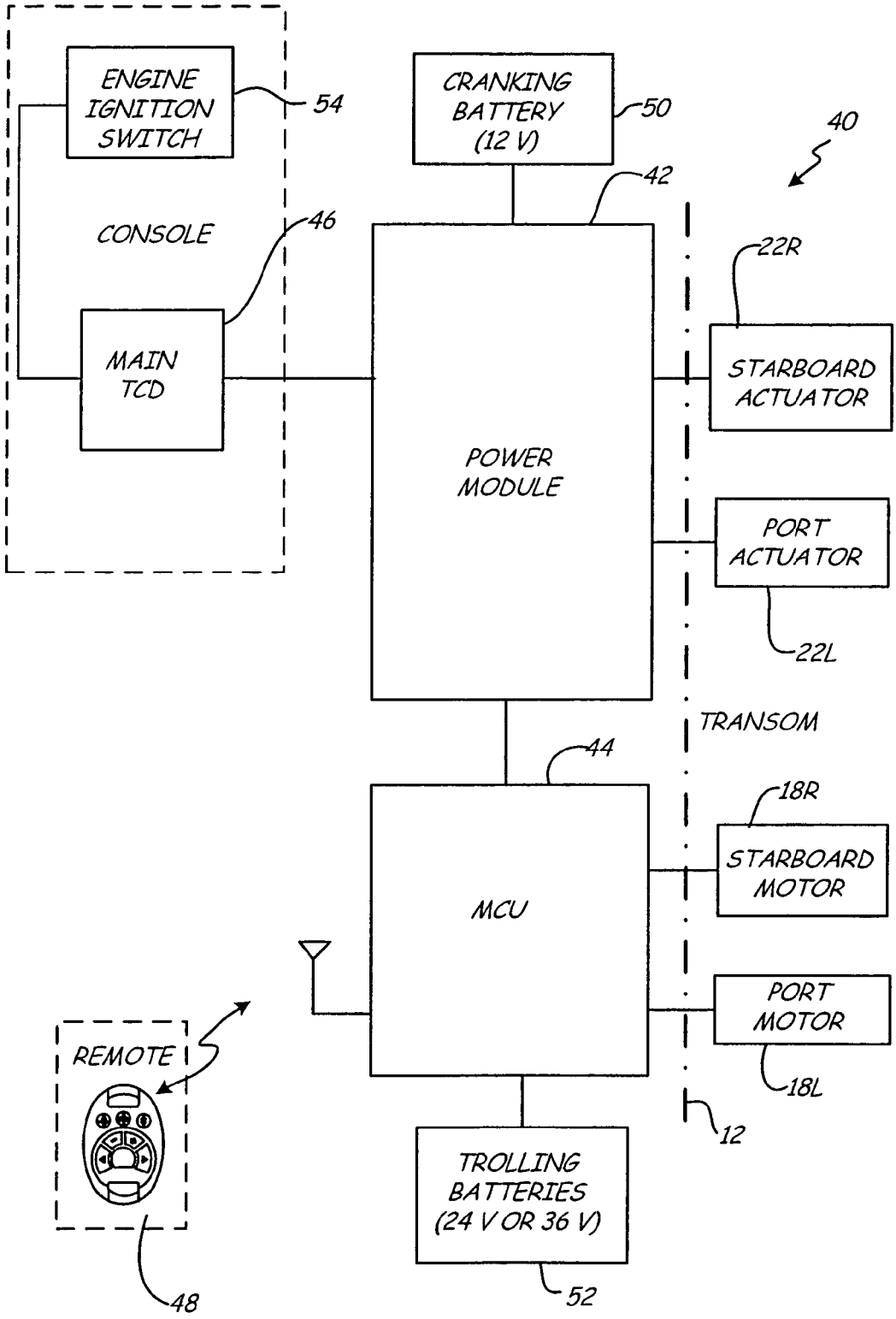
FIG. 3 is a block diagram of the control system for operating the trim tabs and electric trolling motors.

FIG. 3 is a block diagram showing control system 40, which controls the position of trim tab 16L and 16R and the operation of motors 18L and 18R. Control system 40 includes motors 18L and 18R, actuators 22L and 22R, power module 42, motor control unit (MCU) 44, tab control display (TCD) 46 and remote control 48. Also shown in FIG. 3 are cranking battery 50 and trolling battery 52, and main engine ignition switch 54.

Power module 42 is a microprocessor based controller that controls the operation of actuators 22L and 22R to position tabs 16L and 16R, respectively. Power module 42 receives input commands from tab control display 46 and motor control unit 44. The electrical power required to operate actuators 22L and 22R is provided to power module 42 by cranking battery 50. Power module 42 drives actuators 22L and 22R as a function of the input commands. Actuators 22L, 22R each include an electric actuator motor (not shown) that drives actuator rod 30L, 30R through a gearbox and an acme screw. Actuator rods 30L, 30R move linearly out of or into actuator housings 28L, 28R, respectively as rods 30L, 30R are driven by the actuator motors. A magnet on the motor shaft and a magnetic sensor, such as a reed switch, within each actuator 22L, 22R, produce tachometer signal pulses. In addition, a limit switch in each actuator 22L, 22R senses when actuator rod 30L, 30R reaches an upper limit position, which corresponds to the fully retracted position of the trim tab.

Power module 42 receives as feedback the tachometer signal and the upper limit signal from each actuator 22L, 22R. From the feedback signals, power module 42 can determine the extension of each actuator 22L, 22R, and thus the positions of tabs 16L and 16R.

Power module 42 maintains a tab position count for each trim tab 16L, 16R, which power module 42 increments or decrements with each tachometer pulse, depending on the direction of rotation of the actuator motor. Power module 42 controls the operation of the actuator motors, and thus knows the direction of rotation of each actuator motor. The tab position count is based upon the number of tachometer signal pulses received and their direction since the last time the upper limit switch was closed. The fully retracted position defined by the upper limit switch is a reference point for the tab position count, which is synchronized each time the upper limit switch is closed. The positions of tabs 16L and 16R, based on the counts maintained by power module 42 are displayed on tab control display 46.

During a "learn function" initiated by simultaneous pressing of two or more buttons on tab control display 46, power module 42 drives actuators 22L, 22R to the fully extended end-of-stroke position. Power module 42 then drives actuators 22L, 22R until the upper limit switches signal that the fully retracted position is reached. Power module 42 counts the number of tachometer pulses between the two positions. From that count, power module 42 identifies whether actuators 22L, 22R are long, medium or short stroke actuators, and determines how many pulses correspond to one light emitting diode (LED) increment on tab control display 46.

Power module 42 also periodically stores the current tab position counts in non-volatile memory. The last stored tab positions at system power down are recalled upon system power up, and tab position indicating LEDs on tab control display 46 are updated based on the recalled values. As a result, control system 40 does not require that tabs 16L and 16R start in the fully retracted position upon power up or be driven to the fully retracted position before operation can start.

Motor control unit 44 is capable of independently controlling the speed and rotation direction of each motor 18L and 18R. Motor control unit 44 is a microprocessor based controller that contains motor drive circuitry for driving each motor 18L, 18R. Motor control unit 44 also includes an RF receiver to take commands from remote control 48. Motor control unit 44 communicates with power module 42 via a cable connection to receive input commands supplied by tab control display 46.

Tab control display 46 is a user interface for controlling tab position while tabs 16L, 16R are in the trim range (from the fully retracted position to approximately 20° down). LEDs on tab control display 46 indicate the positions of tabs 16L and 16R in the trim range, as well as in the troll range (from approximately 20° to full down). Tab control display 46 also receives as an input the state of engine ignition switch 54. The state of ignition switch 54 is provided, along with other input commands, to power module 42. Although one tab control display 46 is shown in FIG. 3, control system 40 can include multiple tab control displays of different locations on the boat.

Remote control 48 is used to issue commands to motor control unit 44 for controlling the operation of trolling motors 18L and 18R. These command functions include turning the propellers on and off, controlling propeller speed, controlling propeller direction, and steering (left, right, and return-to-center). Remote control 48 also provides commands used by power module 42 to move tabs 16L and 16R into the troll range and to adjust them within the troll range. Commands from remote control 48 to control the tabs are provided by motor control unit 44 to power module 42. Although one remote control 48 is shown, control system 40 can include multiple remote controls.

Figure 4:
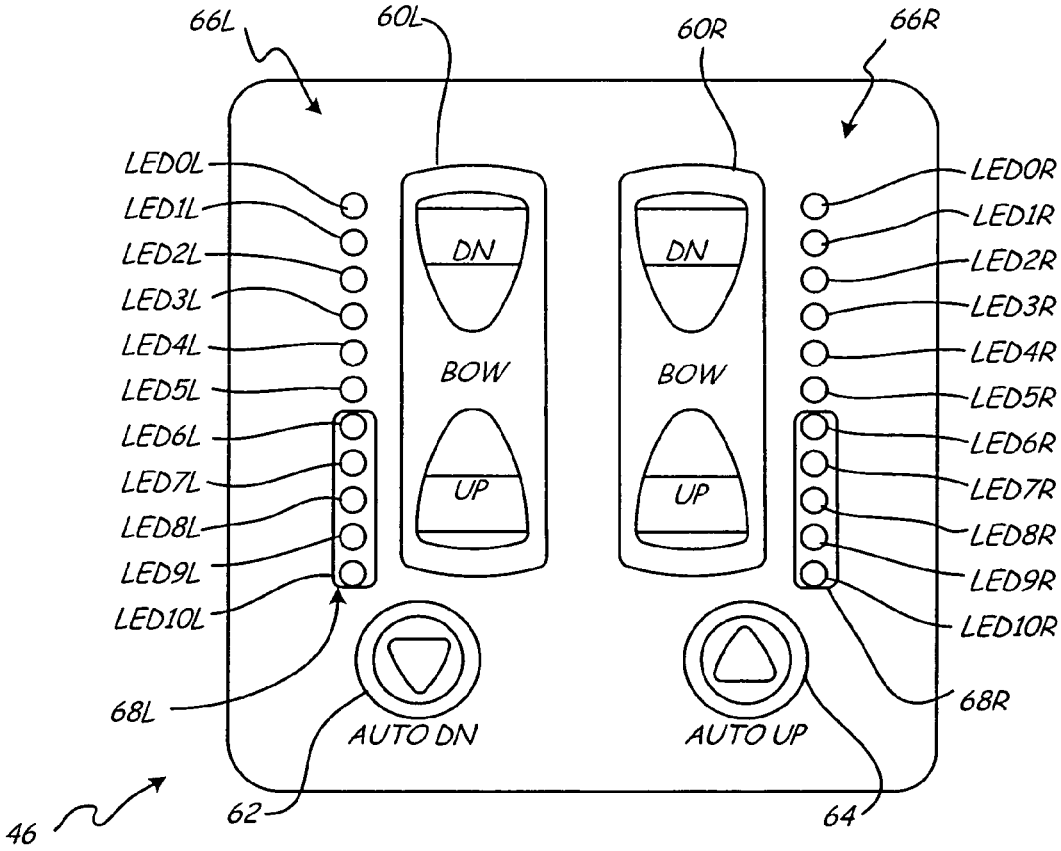
FIG. 4 shows a control panel of the control system.

FIG. 4 shows tab control display 46, which is typically mounted on the console of boat 10. In this embodiment, tab control display 46 includes bow up/down rocker switches 50L and 60R, Auto Down switch 62, Auto Up switch 64, trim position displays 66L and 66R and troll position displays 68L and 68R.

Trim position display 66L is a linear array of eleven light emitting diodes LED0L-LED10L. LED0L is lit whenever trim tab 16L is being controlled by power module 42. Light emitting diodes LED1L-LED10L are lit to indicate the position of left trim tab 16L within the trim range. When only LED0L is lit, tab 16L is in its uppermost or fully retracted position. LED0L may be a different color than the remaining LEDs in display 66L. As trim tab 16L is driven downward, additional LEDs in display 66L are lit. All of the light emitting diodes LED1L through LED10L are lit when trim tab 16L is at the bottom of trim range position.

Similarly trim position display 66R includes eleven light emitting diodes LED0R-LED10R and operates in a similar manner to display 66L. The position of trim tab 16R in the trim range is indicated by the LEDs that are lit in display 66R.

Troll displays 68L and 68R use light omitting diodes LED6L-LED10L and LED6R-LED10R, respectively, to indicate the position of trim tabs 16L and 16R when they are in the troll range. Both trim tabs 16L, 16R should be at the same angle when they are in the troll range. When LED6L and LED6R are lit, trim tabs 16L and 16R are at the top of the troll range, which is slightly below the bottom of trim range position. As trim tabs 16L and 16R are lowered, additional light emitting diodes are lit until all of the LEDs (i.e. LED6L-LED10L and LED6R-LED10R) are lit, and tabs 16L and 16R are at the bottom of the troll range.

Rocker switches 60L and 60R are used to provide commands to power module 42 to raise or lower trim tabs 16L and 16R, respectively. When rocker switches 60L and 60R are pressed in the bow down (DN) direction, tabs 16L and 16R are driven downward. This has the effect of lowering the bow. When rocker switches 60L and 60R are pressed in the bow up direction, the commands to power module 42 cause actuators 22L and 22R to raise trim tabs 16L and 16R, which tends to raise the bow. Rocker switches 60L and 60R allow individual positioning of trim tabs 16L and 16R within the trim range.

Auto Down Switch 62 and Auto Up Switch 64 are operable when trim tabs 16L and 16R are on the trim range. Pressing Auto Down switch 62 sends a command to power module 42 to drive actuators 22L and 22R so that trim tabs 16L and 16R are both lowered toward the bottom position of the trim range. Momentarily pressing Auto Down switch 62 initiates the Auto Down feature, and switch 62 can be released while trim tabs 16L and 16R are driven downward. If any other button is pressed while tabs 16L and 16R are lowering, power module 42 will cause trim tabs 16L and 16R to stop at their current position. If no other button is pressed, tabs 16L and 16R will stop when they reach the bottom of trim range position.

Momentarily pressing Auto Up button 64 provides a command to power module 42 to drive both actuators 22L and 22R until both trim tabs 16L and 16R are at the full retract position. If any other button is pushed during the Auto Up function while tabs 16L and 16R are being raised, power module 42 will cause tabs 16L and 16R to stop at their current position when that button was pushed.

As shown in FIG. 4, tab control display 46 provides commands to control the position of tabs 16L and 16R within the trim range, and it displays tab position within both the trim range and the troll range. It does not, however, provide commands to control positioning of tabs 16L and 16R in the troll range. Nor does tab control display 46 provide commands to operate motors 18L and 18R when in trolling operation. Those control commands are provided by remote control 48. Pressing any button on tab control display 46 while in troll range will cause automatic retraction to the trim range and turning off of trolling motors 18L, 18R.

Figure 5:
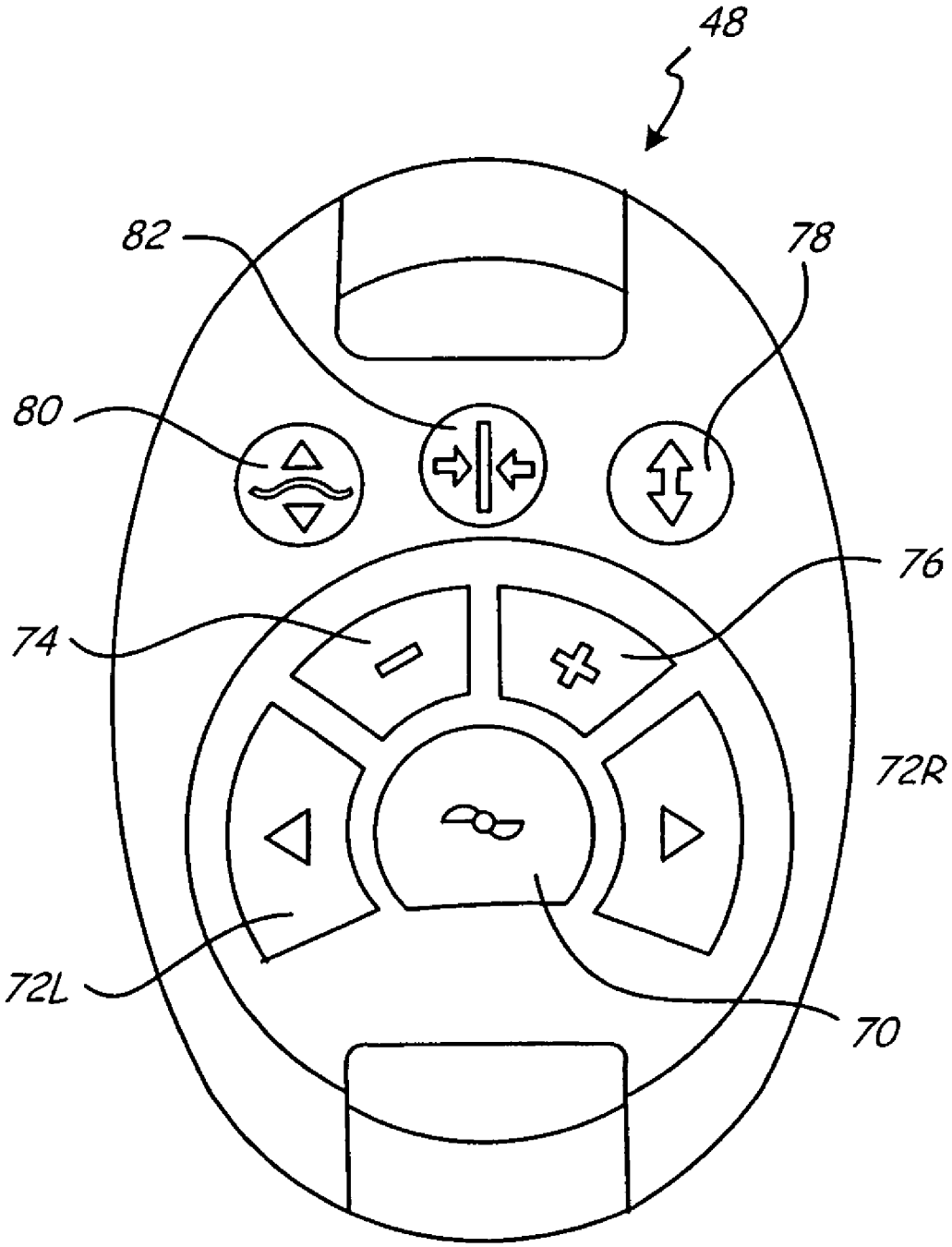
FIG. 5 shows a remote control for providing commands to control operation of the trim tabs and trolling motors.

FIG. 5 shows remote control 48, which is a small, handheld, battery powered device that provides commands to motor control unit 44 and power module 42 by RF signals. Remote control 48 includes an RF transmitter and a built in antenna for communicating with the antenna and RF receiver of motor control unit 44.

Remote control 48 includes prop on/off switch 70, steer left switch 72L, steer right switch 72R, speed down switch 74, speed up switch 76, forward/reverse switch 78, troll deploy switch 80, and return-to-center switch 82.

With prop on/off switch 70, remote control 48 can turn both motors 18L and 18R on and off. With both motors on, the operator can decrease or increase speed of both motors with speed down switch 74 and speed up switch 76, and can determine the direction of rotation of both propellers with forward/reverse switch 78.

Deploying trim tabs 16L and 16R (and motors 18L and 18R) to the troll range, and raising and lowering them within the troll range, is controlled through troll deploy switch 80 of remote control 48. When trim tabs 16L and 16R are in the trim range, pressing troll deploy switch 80 will cause trim tabs 16L and 16R to move to the bottom end of the troll range. Once in the troll range, trim tabs 16L and 16R move as long as troll deploy switch 80 is held down. Movement of trim tabs 16L and 16R changes direction each time switch 80 is released and then pressed again. To move trim tabs 16L and 16R out of the troll range, either tab control display 46 is used, or ignition switch 54 is turned on (as discussed later).

Steering is controlled using steer left switch 72L and steer right switch 72R. Since motors 18L and 18R are rigidly mounted to trim tabs 16L and 16R, steering is achieved by controlling the speed and the direction of rotation of each motor independently, rather than by rotating motors 18L and 18R to the left and right. Motor control unit 44, under the control of remote control 48, can control the motor speed and the direction of propeller rotation of each motor 18L, 18R to provide the desired steering.

When a steer left command is received motor control unit 44 will increase the speed of motor 18R and decrease the speed of motor 18L from the current speed setting, which was based on commands from speed up and speed down switches 74 and 76. Similarly, when a steer right command is received, motor control unit 44 will increase the speed of motor 18L and decrease the speed of motor 18R from their current speed setting. The longer that steer left switch 72L or steer right switch 72R is held, the greater the relative difference in thrust from motors 18L and 18R and the sharper the turn. When a very sharp turn is commanded, one of the motors 18L, 18R may have its speed reduced to zero and then increased with its propeller rotated in an opposite direction. In that case, propellers 24L and 24R may be rotating in opposite directions to obtain the needed difference in thrust.

While the user can visually observe the direction that boat 10 is moving during a steering operation, there is no visual feedback on remote control 48 (or on tab control display 46) to indicate what the steering proportion is between motors 18L and 18R. Depending upon the size of the boat and the amount of thrust that is being provided by motors 18L, 18R at the time, the response of boat 10 to a change in steering proportion can sometimes lag. Once the operator has steered boat 10 to a desired heading, the operator generally will want to continue on that heading. To do so, the operator must be able to adjust the steering so that it is neutral (i.e., both motors 18L and 18R applying the same thrust in the same direction).

Remote control 48 and motor control unit 44 provide a Return-to-Center feature that allows the operator to return the steering to neutral when the desired heading has been achieved. Return-to-center switch 82 provides a return-to-center command to motor control unit 44 to cause both motors 18L and 18R to be driven at the same speed and in the same direction. The speed will be that which was previously set by the operator using speed down switch 74 and speed up switch 76 on remote control 48. The propeller direction will be that which was previously set by the operator using the forward/reverse switch 78. In other words, return-to-center switch 82 causes the speed and propeller direction to be reset to their settings just before a steering operation began. Those settings are stored by motor control unit 44 to allow a reset to occur.

Return-to-center switch 82 can be pressed at any time, and will immediately cause the steering to return to a neutral condition in which motors 18L and 18R are in balance (i.e., they are both being driven in the same direction at the same speed). This is particularly advantageous when the operator has been required to make an abrupt turn, so that the thrust of the two motors may be very different or even in opposite directions. The use of a single switch (return-to-center switch 82) makes the Return-to-Center feature easy to use and intuitive for the operator.

Control system 30 also includes an Auto Retract Troll feature. When tab 16L and 16R are in the troll range, control system 30 monitors the status of main engine ignition switch 54. If the operator turns on main engine ignition switch 54, power module 42 provides control signals to actuators 22L and 22R to raise trim tabs 16L and 16R to the bottom of trim range position. This avoids a situation where the operator starts the main engine and begins to drive boat 10 at high speed, while having forgotten that trim tabs 16L and 16R are in the troll range and thus will provide excessive bow-down trimming.

The automatic retraction of trim tabs 16L and 16R to the trim range when main engine ignition switch 54 turns on also causes motors 18L and 18R to be turned off. When tabs 16L and 16R move to a position out of the troll range, power module 42 provides a signal to motor control unit 44, which automatically turns off motors 18L and 18R.

Although the Auto Retract Troll feature is particularly useful with trim tab mounted trolling motors, it can also be used with other trolling motor systems that provided powered raising and lowering of the trolling motor. The monitoring of the on/off state of the main engine allows a control system to provide automatic raising of the trolling motor when the main engine turns on.

Although the present invention has been described with reference to preferred embodiments, workers skilled in the art will recognize that changes may be made in form and detail without departing from the spirit and scope of the invention.

The invention claimed is:

1. A trolling system for use with a boat having a main engine, the system comprising:

a trolling motor;

a positioning apparatus for raising and lowering the trolling motor; and a control system for controlling operation of the trolling motor and the positioning apparatus, the control system responsive to the main engine being turned on while the trolling motor is deployed in a trolling range to cause the positioning apparatus to raise the trolling motor to a position above the trolling range;

wherein the control system monitors a signal representative of state of an ignition switch of the main engine to determine when the main engine is turned on.

2. The system of claim 1, wherein the positioning apparatus comprises:

a trim tab for supporting the trolling motor; and an actuator for raising and lowering the trim tab.

3. The system of claim 1, wherein the control system turns off the trolling motor when the trolling motor is moved out of the troll range.

4. A trimming and trolling system for use with a boat having a main engine, the system comprising:

a trim tab;

a trolling motor mounted on the trim tab;

an actuator for raising and lowering the trim tab within a trim range and a troll range; and a control system for controlling the trolling motor and the actuator, the control system being responsive to the main engine being turned on to cause the actuator to move the trim tab out of the troll range;

wherein the control system monitors a signal representative of state of an ignition switch of the main engine to determine when the main engine is turned on.

5. The system of claim 4, wherein the position out of the troll range is located above the troll range.

6. The system of claim 4, wherein the control system turns off the trolling motor when the trim tab is moved out of the troll range.

7. The system of claim 4, wherein the trim range is located above the troll range.

8. A boat trimming and trolling system comprising:

a left trim tab;

a left trolling motor mounted on the left trim tab;

a left actuator for raising and lowering the left trim tab;

a right trim tab;

a right trolling motor mounted on the right trim tab;

a right actuator for raising and lowering the right trim tab;

a control system for controlling operation of the left and right actuators and the left and right trolling motors, the control system controlling the left and right actuators to position the left and right trim tabs within a trim range during a trimming mode and within a trolling range during a trolling mode, the control system being responsive to electrical power to a main boat engine being turned on when the control system is in the trolling mode to cause the left and right actuators to move the left and right trim tabs to a position out of the troll range.

9. The system of claim 8, wherein the control system monitors a signal representative of a state of an ignition switch of the main boat engine to determine when electrical power to the main boat engine is turned on.

10. The system of claim 8, wherein the position out of the troll range is located above the troll range.

11. The system of claim 8, wherein the control system turns off the left and right trolling motors when the left and right trim tabs are moved to a position out of the troll range.

12. The system of claim 8, wherein the trim range is located above the troll range.

* * * * *